United States Patent [19]

Thomas

[11] 4,056,115

[45] Nov. 1, 1977

[54] ADAPTER FOR MANIPULATING A SPRING LOADED PUSHBUTTON

[76] Inventor: Morton I. Thomas, 101 Gedney St., Nyack, N.Y. 10960

[21] Appl. No.: 683,978

[22] Filed: May 6, 1976

[51] Int. Cl.[2] ..... A45B 1/00

[52] U.S. Cl. ..... 135/67; 403/108; 403/322

[58] Field of Search ..... 403/108, 109, 322, 324, 403/328, 33; 248/408, 409; 135/67, 75

[56] References Cited

U.S. PATENT DOCUMENTS

| | | | |
|---|---|---|---|
| 657,468 | 9/1900 | Taylor | 403/108 |
| 2,099,460 | 11/1937 | Bell | 403/108 X |
| 2,594,605 | 4/1952 | Zoppelt | 403/108 X |
| 3,104,477 | 9/1963 | Edwill | 403/328 X |
| 3,214,187 | 10/1965 | Fuerst | 403/328 X |
| 3,886,962 | 6/1975 | Diamontis | 403/322 X |
| 3,947,140 | 3/1976 | Thomas | 403/108 |

FOREIGN PATENT DOCUMENTS

| | | | |
|---|---|---|---|
| 1,133,212 | 11/1968 | United Kingdom | 403/328 |

*Primary Examiner*—Andrew V. Kundrat

*Attorney, Agent, or Firm*—Behr & Woodbridge

[57] ABSTRACT

An adapter is employed to assist in the releasing of spring-loaded pushbuttons of the sort frequently associated with invalid equipment. The adapter comprises a collar, a plunger which passes through a hole in the collar, and a pressure plate connected at one end of the plunger. In the preferred embodiment the adapter is employed to release a pushbutton that locks an inner tubular telescoping member with respect to an outer tubular member. The collar is provided with an interior opening which may be force fitted into position around the outer tubular member. When correctly aligned, the plunger is located directly opposite the pushbutton to be depressed. By applying force from the palm of the hand to the pressure plate it is possible to depress the spring loaded release button and thereby unlock the telescoping members. The apparatus just described has two principal advantages: First, it prevents users from getting their fingers caught in the hole between the two telescoping members as the telescoping members collapse; and, second, it allows invalids, such as those individuals with arthritis, to depress the pushbutton with the palm of the hand.

8 Claims, 5 Drawing Figures

ADAPTER FOR MANIPULATING A SPRING LOADED PUSHBUTTON

BACKGROUND OF THE INVENTION

1. Field of the Invention

The invention relates to an adapter which assists in the releasing of spring-loaded pushbuttons.

2. Description of Prior Art

The use of spring-loaded pushbuttons to lock a pair of mutually sliding members is well known to those of ordinary skill in the art. This technique is especially prevalent in the construction of collapsible equipment such as invalid walkers and wheelchairs.

The use of a spring-loaded locking pin in the context of a foldable invalid walker is disclosed in U.S. Pat. No. 3,442,276 to D. W. Edwards and Morton I. Thomas.

It has been recognized in the prior art that the users of folding walkers often have limited manual ability. Accordingly, it is often very difficult for an older person or a person with a disease such as arthritis to release or otherwise manipulate a spring-loaded locking pin. In order to overcome the problems associated with spring-loaded locking pins, the prior art discloses several different approaches. One approach disclosed in U.S. Pat. No. 3,688,789 describes the use of a actuating lever which when squeezed against the frame of the walker tends to draw the locking pin out of its locking hole. Another approach disclosed in U.S. Pat. No. 3,783,886 to Morton I. Thomas describes the use of a lever which when turned sideways causes a cam plate to draw the locking pin away from its locking position.

While such prior art techniques are suitable for some purposes, they do have recognized drawbacks. First of all, the prior art devices generally necessitate the use of the fingers or thumb and are difficult to operate with simple palm pressure. Second, the prior art devices are moderately expensive and can be difficult to manufacture. Third, many of the prior art devices do not address the problem of avoiding a pinch between two collapsing telescoping members. Finally, many of the prior art devices must be manufactured as part of the original equipment and cannot be easily added to the equipment at a later date.

SUMMARY OF THE INVENTION

Briefly described the invention comprises an adapter to assist invalids or otherwise incapacitated individuals in the release of spring-loaded pushbuttons. In the preferred embodiment the invention comprises a collar having an interior opening and an exterior side and a hole communicating the interior opening with the exterior side, a plunger slidably engaged in the hole of said collar and adapted to make contact with a spring-loaded pushbutton and a round pressure plate attached to the plunger at the end furtherest removed from the point at which the plunger makes contact with the spring-loaded pushbutton. A spacer sleeve may also be slidably attached to the plunger and located intermediate the pressure plate and the exterior side of the collar. The interior of the collar includes a substantially rounded section which is slightly smaller in diameter than the outer diameter of the telescoping member to which it may be attached. In the preferred embodiment the collar is attached to the outer tubular telescoping member by physically drive fitting it over the end of the outer tube. The interior portion of the collar also includes a relief section which allows the outer tube to distort slightly and flow during the drive fit of the adaptor apparatus. The interior opening includes a section which allows the plunger to move upwardly and downwardly against the pushbutton.

According to an alternative embodiment of the present invention the pressure plate may be slightly dish shaped so as to accomodate thumb pressure. The geometry of the dish shaped pressure plate allows the adapter to be used without a spacer sleeve for reasons that will be apparent herein.

In order to depress the pushbutton, a user of the preferred adapter merely applies pressure from the palm of the hand on the pressure plate. Since the area of the pressure plate is considerably larger than the area of the spring-loaded pushbutton, it is possible to easily depress the plunger mechanism with the palm of the hand, heel of the hand, or with two or more fingers. The head of the plunger includes a domed shaped portion which is adapted to make contact with the top surface of the spring-loaded pushbutton. Once the pushbutton is depressed, the hole in the outer tubular member may be moved away from the hole in the inner tubular member and thus collapsed. Since the head of the plunger is domed, the plunger is cammed away from the hole in the inner tubular member. The domed shape of the head of the plunger prevents its becoming hung up and stuck in the locking holes of the telescoping tubular members. These and other features of the present invention will be more fully understood with reference to the following drawings and the accompanying detailed description of the invention.

DETAILED DESCRIPTION OF THE INVENTION

During the course of the following description, like numbers will be used to designate like elements according to the different views of the invention.

Figure 1:
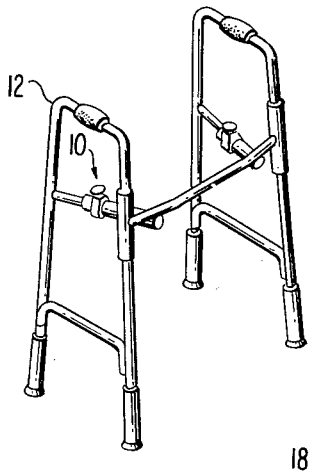
FIG. 1 is a general perspective view of the adapter of the present invention as used in the context of a collapsible invalid walker.

According to FIG. 1, the adapter 10 is shown in position on a folding walker 12. Collapsible or folding walkers which incorporate spring-loaded locking buttons are well known to those of ordinary skill in the art. While a folding walker is illustrated in FIG. 1, there are other devices upon which the adapter 10 of the present invention can be readily employed.

Figure 2:
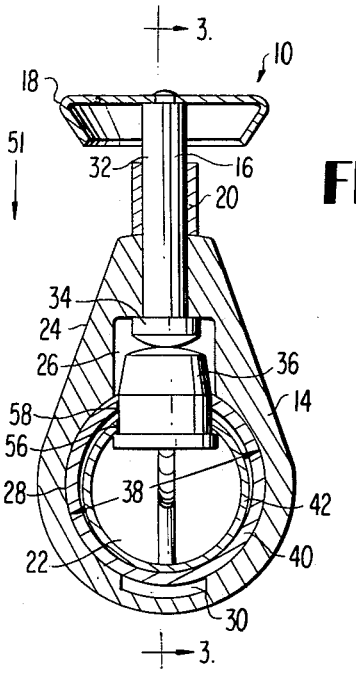
FIG. 2 is a cross-sectional view of the adapter according to the preferred embodiment of the present invention.

The adapter 10 of the present invention is illustrated according to the preferred embodiment thereof in the cross-sectional view of FIG. 2. As seen in FIG. 2, the adapter 10 includes a collar 14, a plunger 16, a flat, round, pressure plate 18 and a spacer sleeve 20. The collar 14 includes an interior opening 22 and an exterior surface or side 24. Interior opening 22 comprises a first upper section 26, a second substantially annular center section 28 and a third relief section 30. The plunger 16 includes a shaft portion 32 and a domed head portion 34.

The domed head 34 is integrally attached to the shaft 32 of the plunger 16. The pressure plate 18 is likewise rigidly attached to plunger shaft 32 at the end thereof furtherest removed from the domed head 34. The plunger shaft 32 extends through a hole in the pressure plate 18 and is attached to pressure plate 18 by deforming the end of shaft 32. The deformation at the end of shaft 32 causes it to expand to dimensions greater than the hole in the pressure plate 18. This attachment is preferably formed by peening the end of shaft 32 but other techniques, such as welding, may be employed just as well.

The first upper section 26 of the interior opening 22 houses the domed head 34 of plunger 16 and the spring-loaded pushbutton 36 when the pushbutton is in its locking mode. The second center section 28 of the interior opening 22 has an inside diameter 38 which is just slightly smaller than the outside diameter of outer tubular member 40. Given these proportions it is possible to easily attach the adapter 10 to the outer telescoping tubular member 40 by driving the adapter 10 over one end of tube. In this manner, a secure drive or jam fit is obtained between the adapter 10 and the outer telescoping tubular member 40. In order to facilitate the drive fit of the adapter 10, a third relief section 30 is made part of the interior opening 22. The relief section 30 allows the material of outer telescoping tube member 40 to flow therein during drive fit assembly. The relief section 30 makes it easier to force the adapter 10 onto outer tubular member 40 and helps to insure a firmer connection thereto. While a drive fit has been described with respect to the attachment of the adapter 10 to telescoping tubular member 40, it will be appreciated by those of ordinary skill in the art that other techniques, such as welding, set screws, etc. can be employed also.

Figure 3:
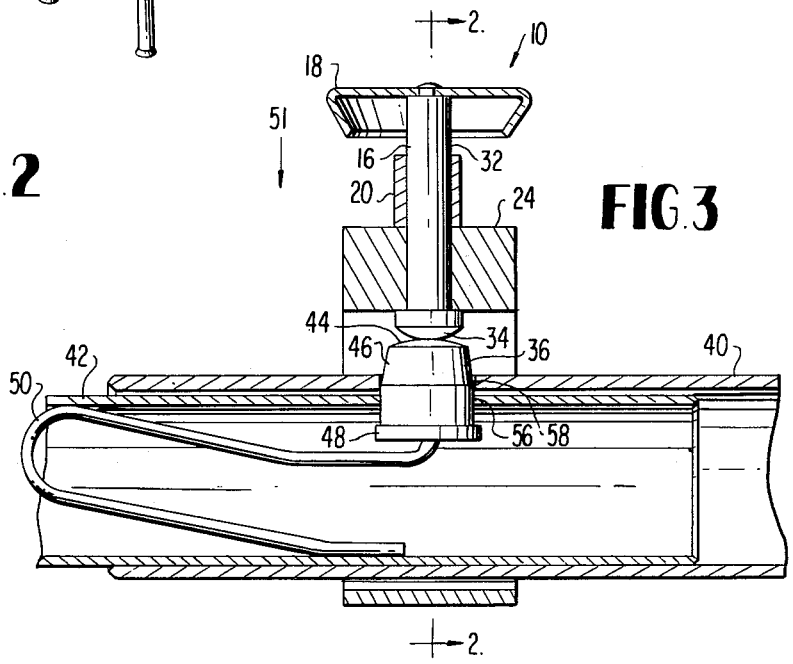
FIG. 3 is a cross-sectional view of the adapter illustrated in FIG. 2 as seen from perspective 3—3.

The adapter 10 is illustrated in cross-sectional view in FIG. 3. It is clear from FIG. 3 that an inner tubular member 42 telescopes into outer tubular member 40. The outside diameter of tube 42 is slightly smaller than the inside diameter of outer tube 40. It is important that the outer diameter of inner tubular member 42 be sufficiently close to the inner diameter of outer tubular member 40 so that the telescoping fit is free from wobble. At the same time, the outer diameter of inner tubular member 42 cannot be so close to the inner diameter of outer tubular member 40 that there is significant frictional interference between the two during the telescoping or unlocking operation of the device. The proportioning of an inner tubular member to an outer tubular member in order to achieve an appropriate telescopic fit is a technique well known to those of ordinary skill in the art and believed to be wholly conventional.

The pushbutton 36 illustrated in FIGS. 2 and 3 is shown to include a slightly domed head portion 44, a tapered sidewall portion 46 and a flat flanged bottom portion 48. A bent wire spring 50 located in the interior of inner tubular member 42 tends to bias pushbutton 36 upward. Both inner tubular member 42 and outer tubular member 40 include holes 56 and 58 respectively therethrough which, when aligned, permit the pushbutton 36 to project beyond the outer surface of outer tubular member 40. The locking holes in telescoping members 40 and 42 are sized to the approximate diameter of the tapered portion 46 of pushbutton 36. The taper of pushbutton 36 allows the telescoping member 40 and 42 to lock securely with regard to one another. As illustrated in FIGS. 2 and 3, the spring-loaded pushbutton 36 is shown in the locking mode in which it projects through the hole 56 and 58 in telescoping members 40 and 42 and wherein the domed head 44 of the pushbutton pin 36 impinges upon the domed head 44 of plunger 16. In order to avoid unnecessary play in the adapter, it may be desirable to dimension the apparatus so that there is always constant spring tension transmitted through pushbutton 36 to the plunger 16. This, of course, can be achieved by the careful dimensioning of the adapter with respect to the pushbutton pin 36.

With spring-loaded pushbutton pin 36 in the locking mode the plunger 16 is biased outward as shown in FIGS. 2 and 3. In order to unlock the pushbutton 36 a user merely applies pressure to the top of pressure plate 18. This pressure may be applied either with the palm of the hand or with a plurality of fingers and/or the thumb. Since the area of the top surface of pressure plate 18 is greater than the effective area of the domed portion 44 of pushbutton 36, it is considerably easier to depress the pushbutton 36 if the fingers and the hands are otherwise incapacitated. The pushbutton release pressure is applied to the top of pressure plate 18 in the direction of arrow 51. Pressure applied in this manner tends to overcome the upward bias of spring 50 and force pushbutton 36 back through the two locking holes 58 and 56 in telescoping members 40 and 42. Once the top portion 44 of pushbutton 36 is driven below the inside surface of outer tubular member 40, it is then possible to collapse the telescoping member by pushing the inner tubular member 42 further into the interior of outer tubular member 40. However, in some special applications it may be desirable to release the pushbutton and draw the inner and outer tubes apart. Once the top surface 44 of the pushbutton 36 is below the inner surface of the outer tubular member 40 and the two tubes are either drawn apart or pushed together, the locking holes in the telescoping members 40 and 42 will tend to separate. The pushbutton 36 stays in the locking hole in tubular member 42 but the hole in outer tubular member 40 moves away. As the hole in outer tubular member 40 moves away it tends to cam the upper domed surface 44 of the pushbutton 36 downwardly while it cams the domed head 34 of the plunger 16 upwardly and away from the pushbutton 36. Further respective movements of the telescoping members 40 and 42 causes the members to completely unlock and allows them to slide readily with respect to one another. The telescoping members 40 and 42 may be subsequently relocked with respect to one another by realigning the locking holes therein opposite one another. When the locking holes are realigned the natural bias of spring 50 forces the pushbutton 36 to project through the locking holes and reassume the locking position illustrated in FIGS. 2 and 3.

As previously described, the area of the surface of pressure plate 18 is greater than the effective area of the domed surface 44 of the pushbutton 36. Since the area of the pressure plate 18 is greater than the area of the head 44 of the pushbutton 36 it is much easier to manipulate and release pushbutton 36. Pressure plate 18 effectively translates a low density force distributed over a wide area to a high density force applied to the pushbutton pin 36. This feature is especially important to individuals who have arthritis or other debilitating diseases or incapacities. In addition, with prior art pushbuttons it was always possible to pinch a finger while collapsing the telescoping tubular members. Injuries frequently occurred when two aligning holes moved away from one another and with the finger still depressed in the hole to prevent the springloaded pushbutton pin from popping back up. The present invention avoids the necessity of having to contact the pin directly and therefore completely overcomes the possibility of injury to the fingers or hands while collapsing a pair of telescoping members.

Figure 4:
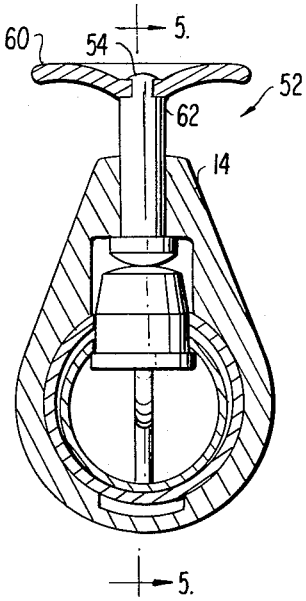
FIG. 4 is a cross-sectional view of an alternative embodiment of the adapter of the present invention.
Figure 5:
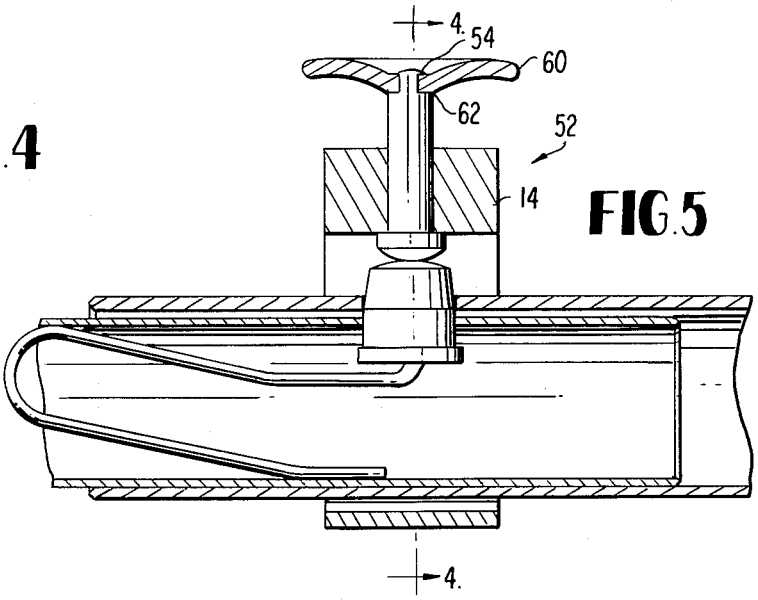
FIG. 5 is a cross-sectional view of the adapter illustrated in FIG. 4 as seen from perspective 5—5.

An alternative embodiment 52 of the present invention is illustrated in FIGS. 4 and 5. Embodiment 52 differs from the preferred embodiment 10 of FIGS. 1–3 in that the pressure plate 60 is dish shaped and includes an indentation 54 in the middle thereof. The indentation 54 serves two principal purposes. First, it allows the adapter to be operated with the thumb or general plunger without fear of the thumb or fingers slipping off of the pressure plate. With a flat pressure plate 18 as shown in FIGS. 2 and 3 the thumb or fingers may slip off. Second, the indent 54 causes the Section 62 of the pressure plate 60 to be the closest point on the pressure plate to the collar 14. Since Section 52 is of uniform dimensions it is not necessary to use a Spacer Sleeve 20 as in the embodiment of FIGS. 2 and 3. The Spacer Sleeve 20 was in part necessitated by the fact that the rounded flat pressure plate 18 does not always have a rim of uniform dimensions. Therefore when the plate was depressed all the way the domed head 34 would bottom at different depths. Accordingly, difficulty in collapsing the tubes was occasionally incurred. Since the embodiment of FIGS. 4 and 5 always bottoms to a uniform, consistent depth the need for a Spacer was largely eliminated.

In view of the foregoing disclosure it will be clear to those of ordinary skill in the art that certain modifications of the basic invention can be made without departing from the general scope and spirit thereof. Some of these modifications have already been described. For example, while the pushbutton has been disclosed as being of the sort with a tapered shaft and a wire spring, it is well known that other types of pushbuttons can be released by the adapter described above. The preferred embodiment of the invention is shown in the context of two tubular members of the sort frequently used on collapsible invalid walkers. However, the present invention can be employed on a wide variety of other devices including but not limited to folding wheelchairs, crutches, tubular lawn furniture and the like, etc. For that matter, the invention in its broader aspects can be employed to release a pushbutton between any two or more slidable members. The slidable members do not necessarily have to be tubular but could, for example, be flat plates or other sliding members. The collar 14 has been described as being made of extruded aluminum but could be made of sintered metal or a variety of other suitable materials. Moreover, the preferred embodiment of the invention discloses the collar 14 to be fitted to the outer tubular member 40 by a drive fit but it will be, of course, appreciated that set screws, welds, or the like could be employed also. The material of the device is preferably aluminum, but could be made from steel or any other suitable material. For that matter it may be preferable to provide for a chrome plated pressure plate 18 in order to reduce the effects of corrosion. The shaft 32 of the plunger 16 is described as being peened so as to attach one end thereof to pressure plate 18. This method of swaging is well known to those of ordinary skill in the art but other attaching means such as welding could be employed also. For that matter, the entire assembly including the domed head 34, the shaft 32 and the pressure plate 18 could be integrally made from one single piece of material. However, this might make the assembly of the adapter a little difficult since it could be hard to fit the plunger thus formed into the hole 26 which communicates the interior opening 22 of the collar 14 to the exterior side 24 thereof.

While the invention has been particularly shown and described with reference to a preferred embodiment thereof, it will be understood by those skilled in the art that various changes in form and detail may be made therein without departing from the spirit and scope of the invention.

I claim:

1. An adapter apparatus for manipulating a spring-loaded pushbutton located between two overlapping members, said overlapping members comprising an inner tubular member which telescopes into an outer tubular member, both of said tubular members including a hole therethrough through which said spring-loaded pushbutton is biased when said holes are aligned one opposite the other, said apparatus comprising:

a support means adapted for rigid connection to one of said overlapping members, said support means comprising a collar which is adapted to fit around said outer tubular member, said collar including an interior opening and an exterior side and a hole communicating said interior opening with said exterior side;

a substantially flat pressure plate;

a plunger slidably engaged by said support means and adapted to make contact with said spring-loaded pushbutton, said plunger including a shaft attached at one end to said pressure plate and at the other end to a domed head which is adapted to make contact with said pushbutton, said shaft of said plunger passing through said collar hole with said pressure plate being located on the exterior side of said collar and said domed head being located within said interior opening; and, a sleeve surrounding said plunger shaft and located between said pressure plate and said collar.

2. The apparatus of claim 1 wherein said interior opening includes the following three sections:

a first section which houses the domed head of said plunger;

a second approximately annular section with a diameter slightly less than the outside diameter of said outer tubular member; and, a third relief section for accomodating the flow of said outer tubular member when said apparatus is assembled on said outer tubular member.

3. The apparatus of claim 2 wherein said collar is formed from extruded aluminum.

4. The apparatus of claim 2 wherein said collar is formed from a sintered metal.

5. The apparatus of claim 2 wherein said tubular telescoping members are part of an invalid walker.

6. An adapter apparatus for manipulating a spring-loaded pushbutton located between two overlapping members, said apparatus comprising:

a collar having an interior opening and an exterior side and a hole communicating said interior opening with said exterior side;

a plunger including a shaft portion which passes through the hole in said collar;

a domed head attached to said plunger shaft, said domed head being located within the interior opening of said collar;

a pressure plate located on the exterior side of said collar and attached to the end of said plunger shaft furtherest removed from said domed head; and, a sleeve surrounding said plunger shaft and located intermediate said pressure plate and the exterior side of said collar.

7. An adapter apparatus for manipulating a spring-loaded pushbutton located between two overlapping members, said apparatus comprising:

a collar having an interior opening and an exterior side and a hole communicating said interior opening with said exterior side;

a plunger including a shaft portion which passes through the hole in said collar;

a domed head attached to one end of said plunger shaft, said domed head being located within the interior opening of said collar;

a pressure plate having a dish-shaped cross section located on the exterior side of said collar and attached at its convex extremity to the end of said plunger shaft furtherest removed from said domed head and with the convex extremety of said plate providing an extension of said plunger shaft at its point of attachment thereto; and, with said point of attachment providing a stop means located on the exterior side of said collar for preventing said plunger from being depressed beyond a predetermined uniform limit while the concavity of said plate prevents the thumb or finger of an operator from slipping off the plate.

8. An adapter apparatus for manipulating a spring-loaded pushbutton located between two overlapping members, said apparatus comprising:

a collar having an interior opening and an exterior side and a hole communicating said interior opening with said exterior side;

a plunger including a shaft portion which passes through the hole in said collar;

a domed head attached to said plunger shaft, said domed head being located whthin the interior opening of said collar;

a pressure plate located on the exterior side of said collar and attached to the end of said plunger shaft furtherest removed from said domed head; and, a stop means located on the exterior side of said collar for preventing said plunger from being depressed beyond a predetermined uniform limit, and wherein said stop means comprises a sleeve surrounding said plunger shaft and located intermediate said pressure plate and the exterior side of said collar.

* * * * *